US008619091B2

(12) United States Patent
Kim

(10) Patent No.: US 8,619,091 B2
(45) Date of Patent: Dec. 31, 2013

(54) BRIGHTNESS ADJUSTING DEVICE OF VIDEO DISPLAY APPARATUS AND CONTROL METHOD OF THE SAME

(75) Inventor: Sung Min Kim, Pyeongtaek-si (KR)

(73) Assignee: LG Electronics Inc., Seoul (KR)

( * ) Notice: Subject to any disclaimer, the term of this patent is extended or adjusted under 35 U.S.C. 154(b) by 494 days.

(21) Appl. No.: 13/062,183

(22) PCT Filed: Sep. 4, 2009

(86) PCT No.: PCT/KR2009/005020

§ 371 (c)(1),
(2), (4) Date: Mar. 3, 2011

(87) PCT Pub. No.: WO2010/027219

PCT Pub. Date: Mar. 11, 2010

(65) Prior Publication Data

US 2011/0157210 A1 Jun. 30, 2011

(30) Foreign Application Priority Data

Sep. 4, 2008 (KR) ..... 10-2008-0087181

(51) Int. Cl.
*G09G 5/02* (2006.01)

(52) U.S. Cl.
USPC ..... 345/589; 345/690

(58) Field of Classification Search
USPC ..... 345/589, 698, 690, 699; 348/222.1, 687
See application file for complete search history.

(56) References Cited

U.S. PATENT DOCUMENTS

| | | | | |
|---|---|---|---|---|
| 5,808,697 | A | 9/1998 | Fujimura et al. | |
| 7,170,477 | B2 | 1/2007 | Okamoto et al. | |
| 2001/0033260 | A1 | 10/2001 | Nishitani et al. | |
| 2007/0222866 | A1 * | 9/2007 | Serizawa et al. | 348/222.1 |
| 2007/0229863 | A1 | 10/2007 | Ono et al. | |
| 2008/0037866 | A1 | 2/2008 | Na | |

FOREIGN PATENT DOCUMENTS

| | | |
|---|---|---|
| GB | 2 418 316 A | 3/2006 |

* cited by examiner

*Primary Examiner* — Abbas Abdulselam
(74) *Attorney, Agent, or Firm* — Birch, Stewart, Kolasch & Birch, LLP

(57) ABSTRACT

The present invention relates to a video display apparatus. More specifically, the present invention relates to a brightness adjusting device of a video display apparatus that is able to improve perceived contrast ratio by brightness of a video signal input to the video display apparatus having a plasma display panel applied thereto.

11 Claims, 9 Drawing Sheets

INPUT PICTURE PICTURE PROCESSING OTUPUT PICTURE (b)

(a)

BRIGHTNESS ADJUSTING DEVICE OF VIDEO DISPLAY APPARATUS AND CONTROL METHOD OF THE SAME

TECHNICAL FIELD

The present invention relates to a video display apparatus. More specifically, the present invention relates to a brightness adjusting device of a video display apparatus that is able to improve perceived contrast ratio by brightness of a video signal input to the video display apparatus having a plasma display panel applied thereto.

BACKGROUND ART

Generally, the presentable maximum brightness for every video display apparatus is predetermined and the corresponding presented contrast ratio is predetermined. As a result, conventional video display apparatuses have controlled brightness information of a screen by using various technologies to improve the perceived contrast ratio. However, there have been little effects in actual images because of several reasons.

According to one of the technologies, screen brightness is controlled by using an average value of video signals (hereinafter, average picture level (APL)). If this method is applied to a plasma display panel (PDP), the maximum brightness level of the screen is controlled by an auto-power limit (APL) circuit that uses the average picture level.

If such an auto-power limit (APL) control method is described briefly, an average picture level is set high, the maximum brightness level of the screen is lowered to prevent overload to PDP device in an overall bright image. That is, the overall bright image has a high APL and this means that the average brightness of the picture is high. As a result, the maximum brightness of the picture is controlled darker to adjust the power consumed by a PDP module to be below a predetermined level.

An absolute contrast ratio that is a ratio of a maximum brightness to a minimum brightness presentable by the video display apparatus is determined by characteristics of the corresponding video display apparatus. With development of video processing technology, has been under development a technology of improving perceivable brightness ratio by both analyzing an input video image information and adjusting a corresponding video signal. In recent, a compensation value of a picture generated based on an average value of the brightness information of the overall input image brightness has been adapted frequently.

FIG. 1 is a graph illustrating output according to an input of a conventional video signal, using a method in the brightness ratio is adjusted based on a result of measurement of average brightness of an input image signal. That is, in case an average value measured from the input video signal is a predetermined value or smaller, a brightness ratio of a dark area is improved. In case the average value measured from the input video signal is the predetermined value or larger, a brightness ratio of a dark area is improved.

However, according to such the conventional technology, an entire picture is determined only based on the average value of the brightness information on the entire screen input pixels. The perceived brightness ratio could not be improved a lot because there are actual pictures having little change of the average value of the entire picture even when video information has been changing continuously.

For example, in case of a picture having pixels in a highly bright area and in a very dark area in a similar ratio, a picture having only pixels of middle brightness would have an average brightness value and it results in a problem that the brightness ratio cannot be improved.

To overcome such a problem, brightness information on each pixel of a picture in an actual moving picture is analyzed and a relative perceived brightness ratio of the picture is adjusted according to the brightness distribution.

FIG. 2 is a graph illustrating a method of adjusting brightness according to brightness distribution in each conventional band. According to FIG. 2, picture brightness is divided into predetermined areas for bands, respectively, and corresponding brightness information of each band is determined to adjust the brightness ratio.

DISCLOSURE OF INVENTION

Technical Problem

However, according to the above method, brightness information of every pixel composing a picture is analyzed, not applying an identical input/output function to all of the pixels. Then, a different input/output video conversion function is applied to each band of pixel frequency and a band having high frequency is more oblique and a band having relatively low frequency is less oblique, such that an optimal brightness ratio is perceivable in the input video image. As a result, the brightness ratio may be improved only in a predetermined area and the brightness ratio in the entire video image may deteriorate.

Specifically, in case of a video display apparatus including a plasma display panel, if entire brightness of an input picture is heightened according to unique characteristics of the plasma display panel as shown in FIG. 3, APL (Auto Power Limit) that lowers the maximum brightness in proportion to the heightened brightness is applied to reduce electricity consumption and thus a maximum brightness video picture of a final applied input/output function is darkened. As a result, the brightness ratio of the maximum brightness to the minimum brightness would deteriorate.

Technical Solution

To achieve these objects and other advantages and in accordance with the purpose of the invention, as embodied and broadly described herein, a contrast adjusting device of a video display apparatus includes a video signal input unit receiving a video signal; a video analyzing unit analyzing average brightness of the input video signal and brightness frequency of a picture for each signal band; an information processor reading a video signal input/output function stored in a memory unit based on the average brightness information analyzed by the video analyzing unit and calculating an optimal input/output video signal changing function by processing the read input/output function based on the brightness frequency information of the picture for each band; and a control unit outputting a picture having a contrast ratio adjusted according to the optimal video signal changing function calculated by the information processor.

The video analyzing unit may include a APL (Average Picture Level) part calculating an average picture level of the input video signal; and a pixel frequency determining part determining brightness frequency of the picture based on the number ratio of pixels arranged in each band after analyzing brightness information of entire pixels according to the input video signal and dividing plural areas for brightness bands.

The information processor may lower the perceived contrast ratio in a band having a low brightness frequency of the picture and the information processor may heighten the perceived contrast ratio in a band having a high brightness frequency.

The information processor may calculate a video signal changing function compensating a brightness signal with maintaining the average brightness of the picture according to a characteristic of APL (Auto Power Limit) applicable to PDP (Plasma Display Panel).

The information processor may adjust the perceived contrast ratio for each band based on the brightness frequency of the picture to accumulate the acquired input/output functions upward and downward, and the information processor may normalize a middle value of the upward and downward accumulating values to calculate a final input/output function.

In another aspect of the present invention, a method of adjusting contrast of a video display apparatus includes analyzing average brightness of an input video signal and brightness frequency of a picture for each signal band; reading a video signal input/output function stored in a memory unit based on the average brightness information; calculating an optimal video signal changing function by processing the read input/output function based on the brightness frequency information of the picture for each band; and outputting the input picture after adjusting the contrast ratio based on the calculated video signal changing function.

The step of analyzing the brightness frequency of the picture for each band may determine the brightness frequency of the picture based on the number and ratio of pixels arranged in each band, after analyzing brightness information of entire pixels according to the input video signal and dividing the brightness information for different brightness bands.

The step of adjusting the contrast ratio may lower the perceived contrast ratio in a band having a low brightness frequency of the picture and the step may heighten the perceived contrast ratio in a band having a high brightness frequency of the picture.

The step of calculating the input/output video signal changing function may calculate the video signal changing function compensating a brightness signal, with maintaining the average brightness of the video signal according to a characteristic of APL (Auto Power Limit) applicable to PDP (Plasma Display Panel).

The step of calculating the input/output video signal changing function may adjust the perceived contrast ratio for each band based on the brightness frequency of the picture to accumulate the input/output function upward and downward, and the step may normalize the upward and downward accumulating values.

A middle value of the normalized upward and downward accumulating values may be applied as a final input/output video signal changing function.

Advantageous Effects

The present invention has following advantageous effects.

According to the present invention, brightness information of entire pixels are divided into plural area for different bands and brightness of the picture is determined based on brightness frequency and average brightness according to the number and ratio of the pixels arranged in the bands. As a result, brightness of the picture may be determined more precisely.

Furthermore, in an aspect of video signal entire bands, the entire average of the bright signal is not changed. As a result, the present invention is not influenced by the characteristic of APL (Auto Power Limit) only to improve the perceived contrast ratio without any loss of optimal brightness of the picture.

BRIEF DESCRIPTION OF THE DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

BEST MODE

Reference will now be made in detail to the specific embodiments of the present invention, examples of which are illustrated in the accompanying drawings. Wherever possible, the same reference numbers will be used throughout the drawings to refer to the same or like parts.

Figure 1:
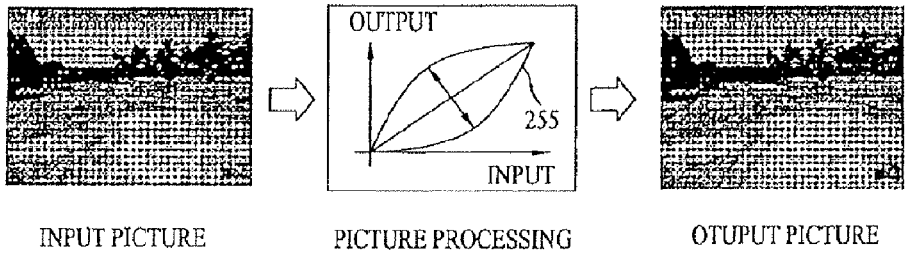
FIGS. 1 to 3 are graphs illustrating a method for adjusting contrast a video display apparatus according to a conventional art, respectively.
Figure 2:
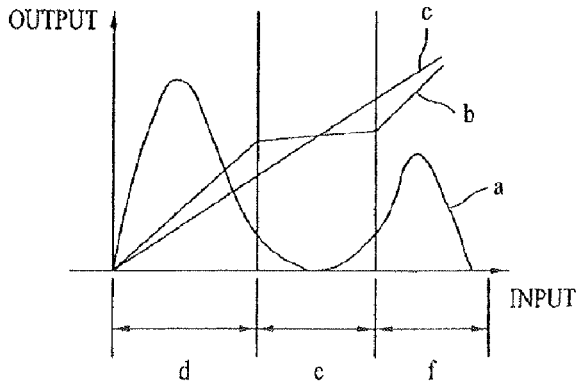
Figure 3:
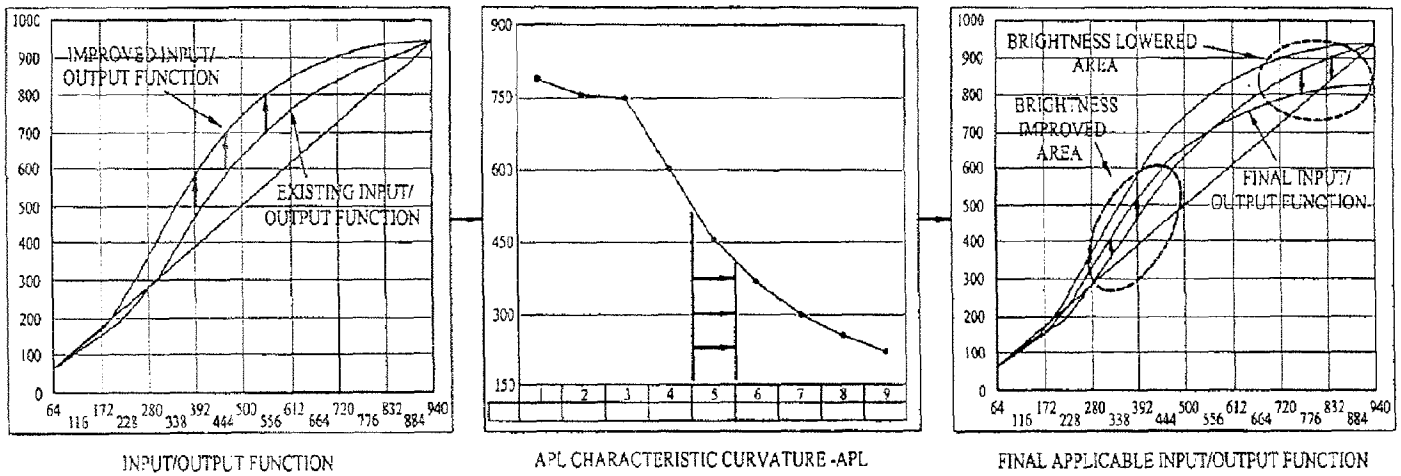
Figure 4:
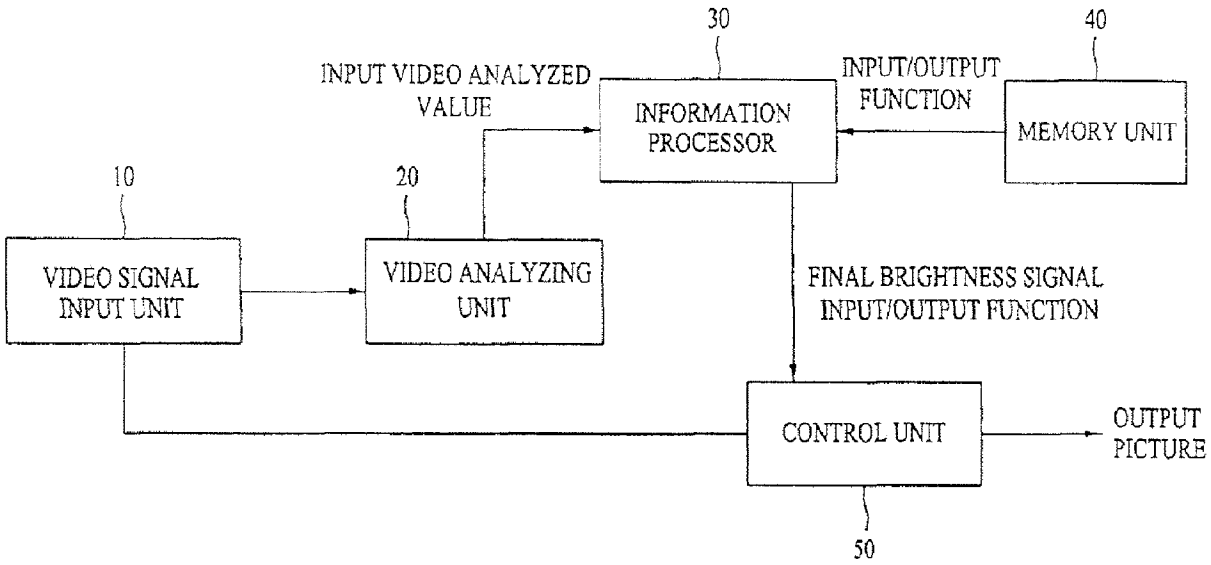
FIG. 4 is a block view illustrating a contrast adjusting device of a video display apparatus according to an exemplary embodiment of the present invention.
Figure 5:
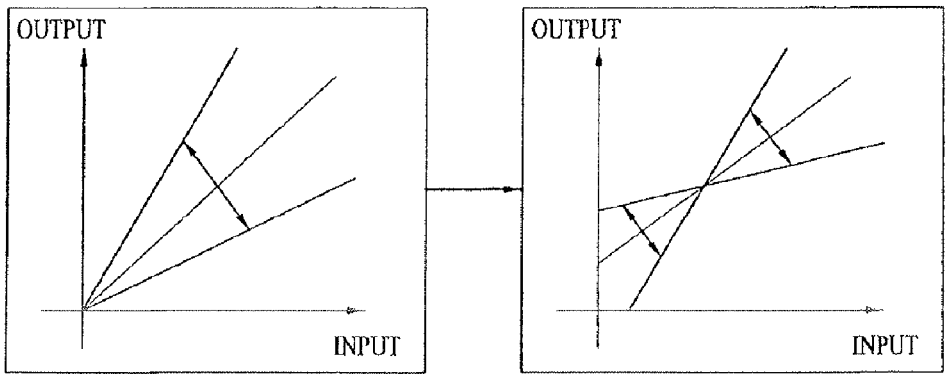
FIG. 5 is a graph illustrating a method for adjusting a brightness signal in consideration of APL characteristics according to the present invention.

FIG. 4 is a block view illustrating a contrast adjusting device of a video display apparatus according to an exemplary embodiment of the present invention. FIG. 5 is a graph illustrating a method for adjusting a brightness signal in consideration of APL characteristics according to the present invention.

As shown in FIG. 4, a contrast adjusting device of a video display apparatus according to an exemplary embodiment of the present invention includes a video signal input unit 10 receiving a video signal, a video analyzing unit 20, an information processor 30 and a control unit 50. The video signal input unit 10 receives a video signal. The video analyzing unit 20 analyzes average brightness of the input video signal and brightness frequency of the video image in each signal band. The information processor 30 reads a video signal input/output function stored in a memory unit 40 by using the average brightness information analyzed by the video analyzing unit 20 and it processes the read input/output function based on the brightness frequency information of the video image in each band to detect an optimal input/output video signal transforming function. The control unit 50 controls to output a video image having contrast adjustment performed according to the video signal transforming function detected by the information processor 30.

The video analyzing unit 20 includes an APL (Average Picture Level) part (not shown) and a pixel frequency determining part (not shown). APL part detects an average brightness value of the video signal input via the video signal input unit 10. the pixel frequency determining part (not shown) analyzes brightness information of entire pixels according to the input video signal and divides the brightness information into information for each bright band to determine brightness frequency based on the number and ratio of the pixels arranged in each band. The acquired average brightness value and brightness frequency for each band may be transmitted to the information processor as an input video analyzed value.

The information processor 30 reads the input/output function corresponding to the average brightness information transmitted from the video analyzing unit 20, which is stored in the memory unit 40, and it applies the brightness information for video images in each band to the read input/output function to adjust brightness.

That is, the perceived contrast ratio is lowered in a band having a low brightness frequency of a picture and it is heightened in a band having a high brightness frequency of a picture such that an optimal input/output video signal changing function may be detected.

Here, the information processor 30 compensates a brightness signal for each band in consideration of APL based on the characteristics of the video display apparatus having PDP (Plasma Display Panel), as shown in FIG. 5.

According to the PDP display apparatus having the characteristic of APL (Auto Power Limit), not to deteriorate an optimal brightness, a brightness signal is compensated and a final brightness signal input/output function is detected, with maintaining an identical APL (Average Picture Level) that is an average brightness value of the picture.

In reference to FIG. 5, the brightness signal is compensated, with a signal level in a predetermined area being heightened and a signal level in the other area being lowered.

Thus, the improved input/output contrast ratio may be acquired with the identical oblique changes in the brightness signal band and the signal distribution may be effectively performed.

In reference to FIG. 6, a method of adjusting contrast of the video display apparatus having the above configuration will be described as follows.

Figure 6:
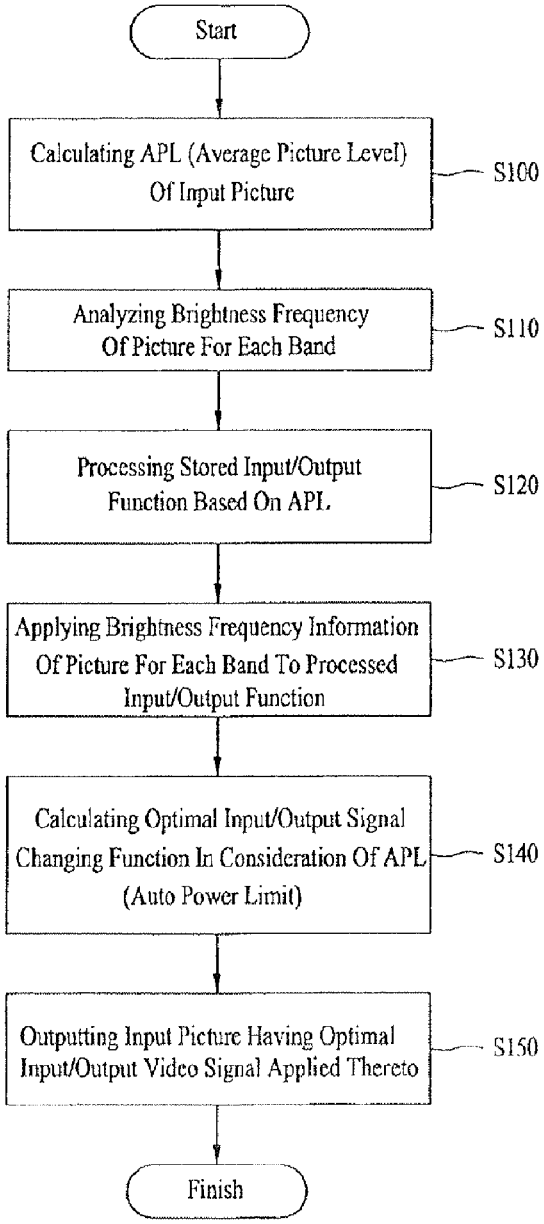
FIG. 6 is a flow chart illustrating a method for adjusting contrast of a video display apparatus according to an embodiment of the present invention.

FIG. 6 is a flow chart illustrating a method of adjusting contrast of a video display apparatus according to an exemplary embodiment of the present invention.

As shown in FIG. 6, after receiving a video signal via the video signal input unit 10, the video analyzing unit 20 calculates an APL (Average Picture Level) of the input video signal (S100).

Hence, brightness information of entire pixels according to the input video signal is analyzed and it is divided into corresponding pieces of information for different brightness bands.

The brightness frequency of the picture is determined based on the number and ratio of the pixels arranged in the divided brightness bands (S110) the acquired average brightness value (that is APL-Average Picture Level) and the frequency information for each band are transmitted to the information processor 30 as input video analyzed value.

Hence, the information processor 30 reads a corresponding video signal input/output function stored in the memory unit 40 based on the APL transmitted from the video analyzing unit 20 (S120). The information processor 30 applies weight of the brightness frequency for each band to the read input/output function calculates the optimal input/output function and it compensates the brightness to calculate the optimal input/output function (S130).

At this time, the information processor 30 lowers the perceived contrast ratio in the band having the low brightness frequency of the video signal and it heightens the perceived contrast ratio in the band having the high brightness frequency to calculate the optimal input/output video signal changing function.

The brightness signal is compensated, with heightening a signal level of a predetermined area and lowering a signal level of the other area correspondingly, (S140) in consideration of the characteristics of the video display apparatus having PDP (Plasma Display Panel). Here, when applying the weight of the pixel frequency, offset is lowered as much as gain is heightened such that contrast may be improved without any changes of APL (Auto Power Limit) of the picture.

FIGS. 7 to 10 are graphs to calculate the final input/output function by using the acquired input/output function according to the method of adjusting contrast of the video display apparatus according to the exemplary embodiment of the present invention.

Figure 7:
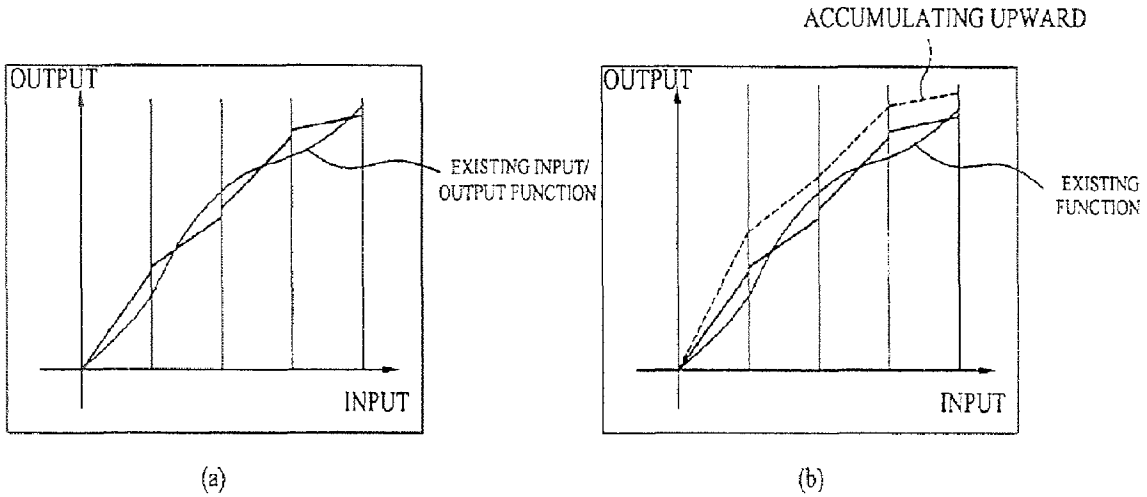
FIG. 7 is a graph illustrating input/output functions accumulated upward that are acquired according to the method for adjusting contrast of the video display apparatus shown in FIG. 6.
Figure 8:
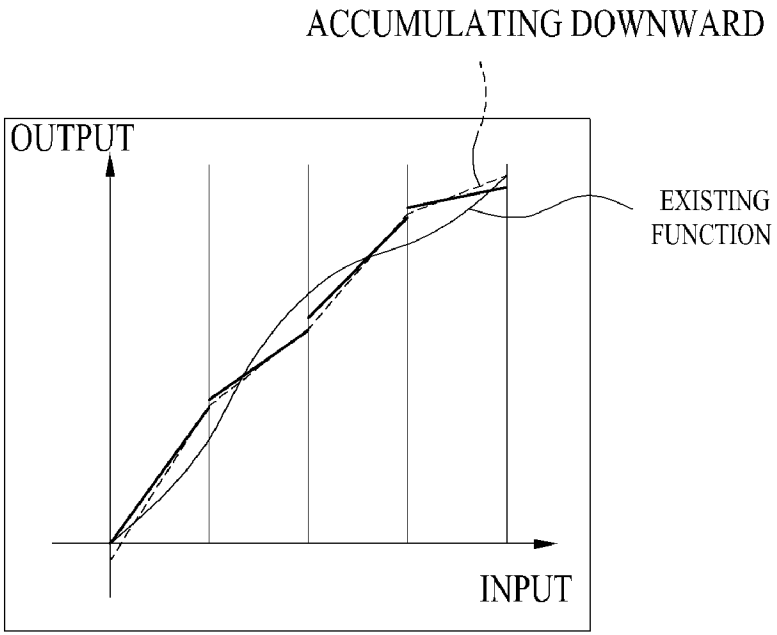
FIG. 8 is a graph illustrating input/output functions accumulated downward that are acquired according to the method shown in FIG. 6.
Figure 8:
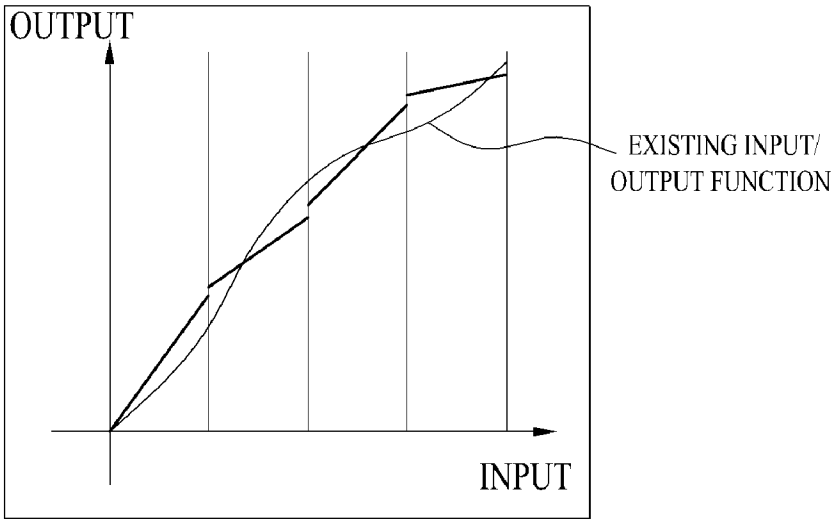

As shown in FIG. 7, if pixel data for each band is high, the input/output function is more oblique. If pixel data is low, the input/output function is less oblique. The above acquired input/output functions accumulate upward and the acquired input/output functions accumulate downward as shown in FIG. 8.

Figure 9:
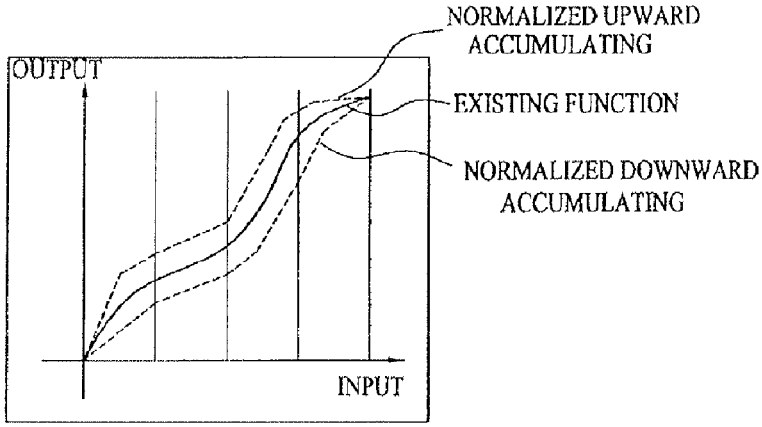
FIG. 9 is a graph illustrating normalized upward/downward accumulating values.
Figure 10:
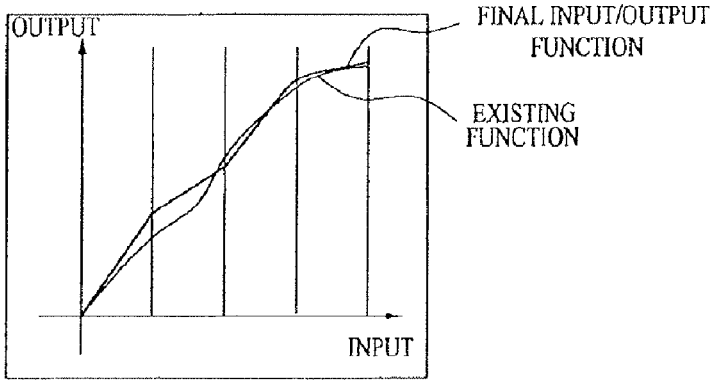
FIG. 10 is a graph illustrating a final input/output function extracted by the method for adjusting contrast of the video display apparatus.

As shown in FIG. 9, the upward and downward accumulating values are normalized. As shown in FIG. 10, a middle value between the normalized upward accumulating value and the normalized downward accumulating value is calculated as final input/output function and the picture is compensated based on the final input/output function.

That is, the control unit 50 adjusts the contrast ratio of the video signal inputted according to the video signal changing function calculated by the information processor 30 and it outputs an optimal picture in the screen (S150).

Terminology adapted in the specification of the present invention is defined in consideration of the function of the present invention and it may be variable according to the intention or practices of people who pertains to this art. The terminology shall be defined based on the overall contents of the description of the present invention.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The present invention has an industrial applicability.

According to the present invention, plural area for brightness signal bands as well as the entire brightness average level of the input picture may be created. The brightness frequency of the picture is determined based on the number and ratio of the pixels arranged in each area to calculate the optimal input/output video signal changing function. The contrast ratio is adjusted according to the optimal input/output function and the perceived contrast ratio for viewers may be improved accordingly.

The invention claimed is:

1. A contrast adjusting device of a video display apparatus comprising:

a video signal input unit receiving a video signal;

a video analyzing unit analyzing average brightness of the input video signal and brightness frequency of a picture for each signal band;

an information processor reading a video signal input/output function stored in a memory unit based on the average brightness information analyzed by the video analyzing unit and calculating an optimal input/output video signal changing function by processing the read input/output function based on the brightness frequency information of the picture for each band; and a control unit outputting a picture having a contrast ratio adjusted according to the optimal video signal changing function calculated by the information processor.

2. The contrast adjusting device of the video display apparatus as claimed in claim 1, wherein the video analyzing unit comprises, a APL (Average Picture Level) part calculating an average picture level of the input video signal; and a pixel frequency determining part determining brightness frequency of the picture based on the number ratio of pixels arranged in each band after analyzing brightness information of entire pixels according to the input video signal and dividing plural areas for brightness bands.

3. The contrast adjusting device of the video display apparatus as claimed in claim 1, wherein the information processor lowers the perceived contrast ratio in a band having a low brightness frequency of the picture and the information processor heightens the perceived contrast ratio in a band having a high brightness frequency.

4. The contrast adjusting device of the video display apparatus as claimed in claim 1, wherein the information processor calculates a video signal changing function compensating a brightness signal with maintaining the average brightness of the picture according to a characteristic of APL (Auto Power Limit) applicable to PDP (Plasma Display Panel).

5. The contrast adjusting device of the video display apparatus as claimed in claim 1, wherein the information processor adjusts the perceived contrast ratio for each band based on the brightness frequency of the picture to accumulate the acquired input/output functions upward and downward, and the information processor normalizes a middle value between the upward and downward accumulating values to calculate a final input/output function.

6. A method of adjusting contrast of a video display apparatus comprising:

analyzing average brightness of an input video signal and brightness frequency of a picture for each signal band;

reading a video signal input/output function stored in a memory unit based on the average brightness information;

calculating an optimal video signal changing function by processing the read input/output function based on the brightness frequency information of the picture for each band; and outputting the input picture after adjusting the contrast ratio based on the calculated video signal changing function.

7. The method of adjusting contrast of the video display apparatus as claimed in claim 6, wherein the step of analyzing the brightness frequency of the picture for each band determines the brightness frequency of the picture based on the number and ratio of pixels arranged in each band, after analyzing brightness information of entire pixels according to the input video signal and dividing the brightness information for different brightness bands.

8. The method of adjusting contrast of the video display apparatus as claimed in claim 6, wherein the step of adjusting the contrast ratio lowers the perceived contrast ratio in a band having a low brightness frequency of the picture and the step heightens the perceived contrast ratio in a band having a high brightness frequency of the picture.

9. The method of adjusting contrast of the video display apparatus as claimed in claim 6, wherein the step of calculating the input/output video signal changing function calculates the video signal changing function compensating a brightness signal, with maintaining the average brightness of the video signal according to a characteristic of APL (Auto Power Limit) applicable to PDP (Plasma Display Panel).

10. The method of adjusting contrast of the video display apparatus as claimed in claim 6, wherein the step of calculating the input/output video signal changing function adjusts the perceived contrast ratio for each band based on the brightness frequency of the picture to accumulate the input/output function upward and downward, and the step normalizes the upward and downward accumulating values.

11. The method of adjusting contrast of the video display apparatus as claimed in claim 10, wherein a middle value of the normalized upward and downward accumulating values is applied as a final input/output video signal changing function.

* * * * *